US006860121B2

(12) United States Patent
Jürgens et al.

(10) Patent No.: US 6,860,121 B2
(45) Date of Patent: Mar. 1, 2005

(54) KNITTING TOOL AND METHOD FOR PRODUCING IT

(75) Inventors: Eric Jürgens, Bisingen (DE); Uwe Stingel, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/753,875

(22) Filed: Jan. 9, 2004

(65) Prior Publication Data

US 2004/0172983 A1 Sep. 9, 2004

(30) Foreign Application Priority Data

Jan. 10, 2003 (DE) ..... 103 00 830

(51) Int. Cl.[7] ..... D04B 35/02
(52) U.S. Cl. ..... 66/123
(58) Field of Search ..... 66/116, 121, 122, 66/123, 124

(56) References Cited

U.S. PATENT DOCUMENTS 1,441,591 A 1/1923 La Montagne
3,949,572 A * 4/1976 Kopal et al. ..... 66/115
4,625,527 A * 12/1986 Fukuhara ..... 66/123
4,681,150 A * 7/1987 Fukuhara ..... 163/5
5,901,582 A * 5/1999 Hennig et al. ..... 66/123
6,122,938 A * 9/2000 Henning et al. ..... 66/123
6,298,692 B1 * 10/2001 Kuroda et al. ..... 66/123

FOREIGN PATENT DOCUMENTS

| | | |
|---|---|---|
| DE | 21 23 971 A | 12/1971 |
| DE | 29 32 207 B1 | 2/1981 |
| DE | 29 44 300 A1 | 5/1981 |
| DE | 196 04 954 C1 | 2/1997 |
| DE | 197 40 985 C2 | 9/1999 |
| DE | 199 39 929 A1 | 4/2000 |
| FR | 688 926 A | 8/1930 |

* cited by examiner

*Primary Examiner*—Danny Worrell
(74) *Attorney, Agent, or Firm*—Fitch, Even, Tabin & Flannery; Norman N. Kunitz

(57) ABSTRACT

A knitting tool (1), particular for high-speed knitting machines, has a shank (2) that is provided with indentations (33, 34). For embodying these indentations, the shank (2) is provided with a slit (25), which creates two legs (29, 31) spaced apart from one another. These legs are bent toward one another so that the desired indentations are created at the flanks (27, 28). The indentations serve to reduce friction and to hold oil.

11 Claims, 4 Drawing Sheets

KNITTING TOOL AND METHOD FOR PRODUCING IT

CROSS REFERENCE TO RELATED APPLICATIONS

This application claims the priority of German Patent Application Number DE 103 00 830.6, filed Jan. 10, 2003, the subject matter of which is incorporated herein by reference.

BACKGROUND OF THE INVENTION

The invention relates to a knitting tool, particularly for high-speed machines, and to a method for producing such a knitting tool.

From German Patent DE 196 04 954 C1, a stamped knitting tool, for instance in the form of a hook or latch needle, is known that has recesses for distributing lubricants in the needle channel on its wide side. The needles must be lubricated in the needle channel, to prevent them from heating up excessively. On the other hand, lubricant must be used sparingly; otherwise, it escapes from the needle channels and gets onto the goods and soils them. With the knitting tools of the aforementioned patent, these conditions are met. The chamfers or recesses of the shank that act as lubricant distributing means form a storage chamber for lubricant. On the other hand, forming the recesses entails relatively great effort and expense. Finally, it cannot be precluded that the recesses will become plugged with dirt and lose their effectiveness.

In German Patent DE 197 40 985 C2, knitting tools have also already been proposed whose shanks have varying thicknesses because recessed open spaces are provided on the shank.

Such knitting tools meet the expectations made of them, but the production cost, as before, is still not inconsiderable.

With the above as the point of departure, the object of the invention to create a knitting tool that has low frictional resistance in the guide channel and that is simple to produce.

SUMMARY OF THE INVENTION

This object is attained with the knitting tool of claim 1 and the production method of claim 10.

The knitting tool of the invention has a shank which can be inserted into a guide channel of a knitting machine and is guided longitudinally movably in the guide channel. The shank has a varying thickness. Regions of reduced thickness can serve for instance as oil holding regions. Each of these regions is formed by legs separated from one another by a slit and curved toward one another. When viewed from the side, the legs thus have concave indentations and are curved away from the observer toward the center of the shank.

It has been found that such knitting tools not only can be produced precisely and economically, but also have good operating properties. The indentations on the flank of the shank that are defined by the legs curved toward one another reduce the surface area with which the knitting tool rests on the guide faces of the guide channel. In addition, chambers for lubricant are created. Moreover, the indentations are free of sharp edges, which keeps dirt from becoming deposited there. Finally, a certain free space which can also serve to hold oil remains between the legs.

It has furthermore been found that the dynamic load-bearing capacity of the knitting tool is high. The legs bent toward one another increase the flexibility of the knitting tool without lessening its strength and load-bearing capacity.

A further advantage of the knitting tool of the invention resides in its symmetry. The two indentations are disposed at the same place on the two opposed flanks of the knitting tool and are preferably both of the same size. This is favorable for the sake of straightness of the knitting tool. Moreover, the indentations on the flanks of the knitting tool can in particular be embodied without burrs on the top and bottom sides of the needle.

The two legs of the shank that are curved toward one another are preferably curved toward a center plane, where they meet or maintain a spacing from one another.

The slit formed between the legs thus has a minimal thickness at the center or is interrupted by a contacting point at which the two legs touch. The legs can be connected to one another at that point as needed. This can be accomplished as needed by means of a material bond or by positive engagement. For instance, a spot weld can be provided there. It is also possible to wedge the legs onto one another, or to rivet them to one another.

Further details of advantageous embodiments will become apparent from the drawing, description and dependent claims.

DETAILED DESCRIPTION OF THE INVENTION

Figures 1, 2, 3, 4, 5:
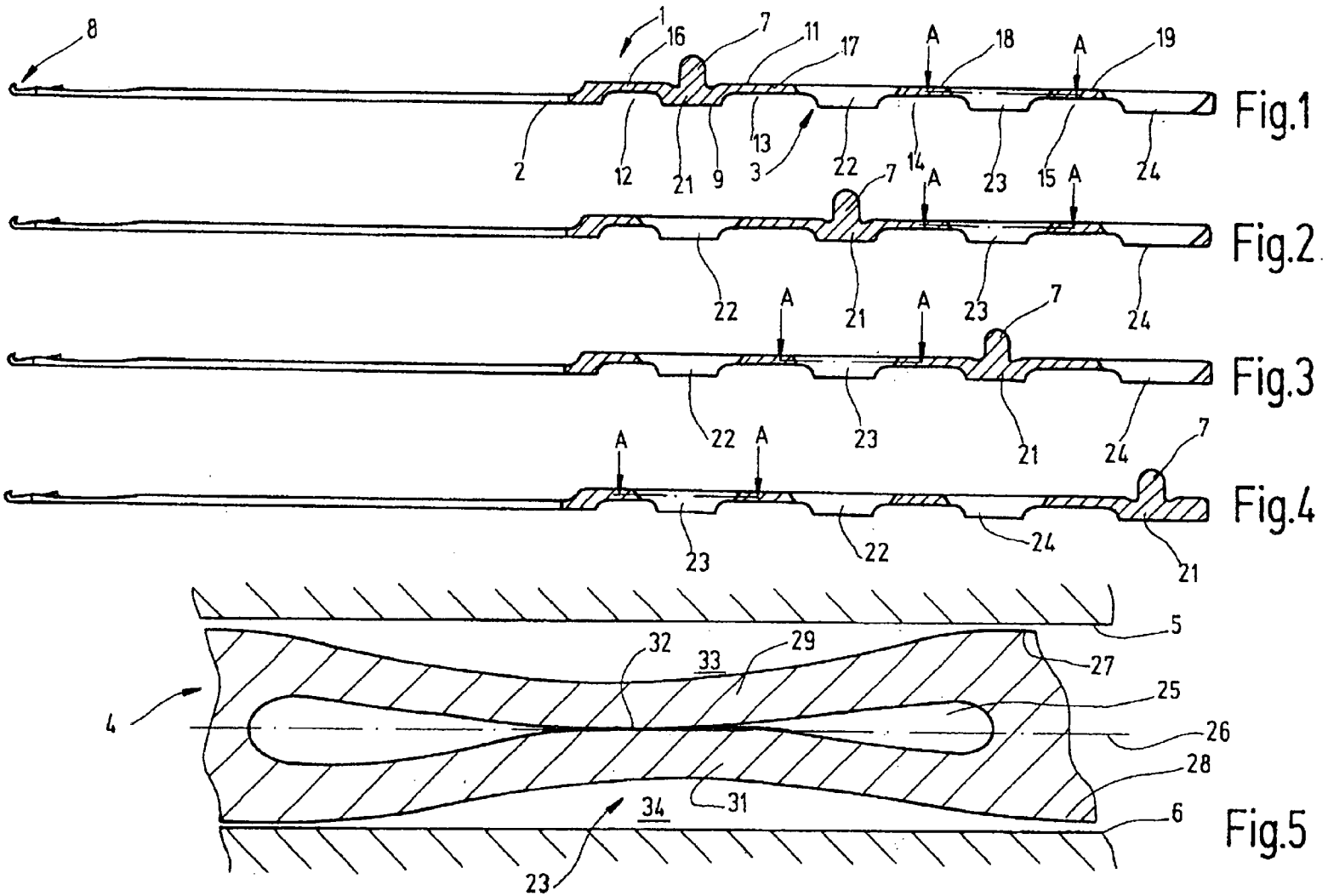
FIGS. 1–4 latch needles with shank indentations on the flanks, in various embodiments each shown in a side view partly in section.
FIG. 5 is a detail view of the respective shank of the latch needles of FIGS. 1–4, in a section taken along the line A—A.

In FIG. 1, a latch needle 1 is shown to represent all elongated knitting tools that are supported movably back and forth in a suitable guide channel. The latch needle 1 has a shank 2, whose rear portion 3, as a guide section, is seated in a guide channel 4 (FIG. 5) of a knitting machine. The guide channel 4 is defined by two guide faces 5, 6, which are preferably embodied as a plane faces. The portion 3, as FIG. 1 also shows, is preferably provided with a butt 7 that serves to drive the latch needle 1. From the portion 3, the shank 2 extends up to a hook 8 or other kind of functional region.

In the portion 3, the shank 2 has a greater height, measured from the needle back 9 to the needle top 11, that is greater than in the front region extending toward the hook 8. In the portion 3, the shank 2 is provided with recesses 12, 13, 14, 15, so that toward the top side 11 of the needle a respective narrow bridge 16, 17, 18, 19 is formed. Between each of the narrow bridges 16, 17, 18, 19, a respective intermediate portion 21, 22, 23, 24 is formed, where the shank 2 is embodied as continuous to its full height. The intermediate portions 22, 23, 24, however, have a reduced thickness. This is clear from FIG. 5, which shows the intermediate portion 23, in a section taken along the line or sectional plane A—A. In the intermediate portion 23, a slit 25 is formed, which extends from the top side 11 of the needle to the needle back 9 and which can, as FIG. 1 shows, extend on into the adjacent narrow bridges 18, 19. The slit 25 is preferably embodied symmetrically to a center plane 26, which in FIG. 1 matches the sectional plane and in FIG. 5 is perpendicular to the plane of the drawing. The center plane 26 is located centrally between the flanks 27, 28 of the shank 2. The width of the slit 25 can for instance make up approximately one-third the total thickness of the shank 2. The slit 25 divides two legs 29, 31 from one another; both legs, on their respective two ends, continue on into the full unslit shank 2. The legs 29, 31 are bent toward one another; as FIG. 5 shows, they can touch at a contacting point 32, by which the slit 25 is interrupted. The contacting point 32 can extend over the entire height of the shank 2 from the needle back 9 to the top side 11 of the needle.

The legs 29, 31 are preferably bent in a continuous curve without shoulders or steps, so that there is no sharp edge on the outer flanks 27, 28 of the shank 2. Instead, the flank 27 merges via a gentle curvature with an indentation 33 that forms a concave arch. The same is correspondingly true for the flank 28, which as a consequence of the bending or curvature of the leg 31 defines a concave indentation 34. The indentations 33, 34 assure that the flank 27, 28 maintains a spacing from the guide faces 5, 6 in the region of the respective indentation 33, 34; this spacing lessens the friction of the latch needle 1 in the guide channel. Moreover, the indentations 33, 34 form chambers in which lubricant can collect and be held.

FIGS. 2, 3 and 4 illustrate modified embodiments of the latch needle of FIG. 1, which differ from one another essentially in the position of the butt 7. Otherwise, the above description applies accordingly, wherever the reference numerals are the same. It is true of all the exemplary embodiments that the intermediate portion 21, which carries the butt 7, is embodied without a slit and without any lateral indentation. However, if needed, indentations can be provided there as well.

Figure 6:
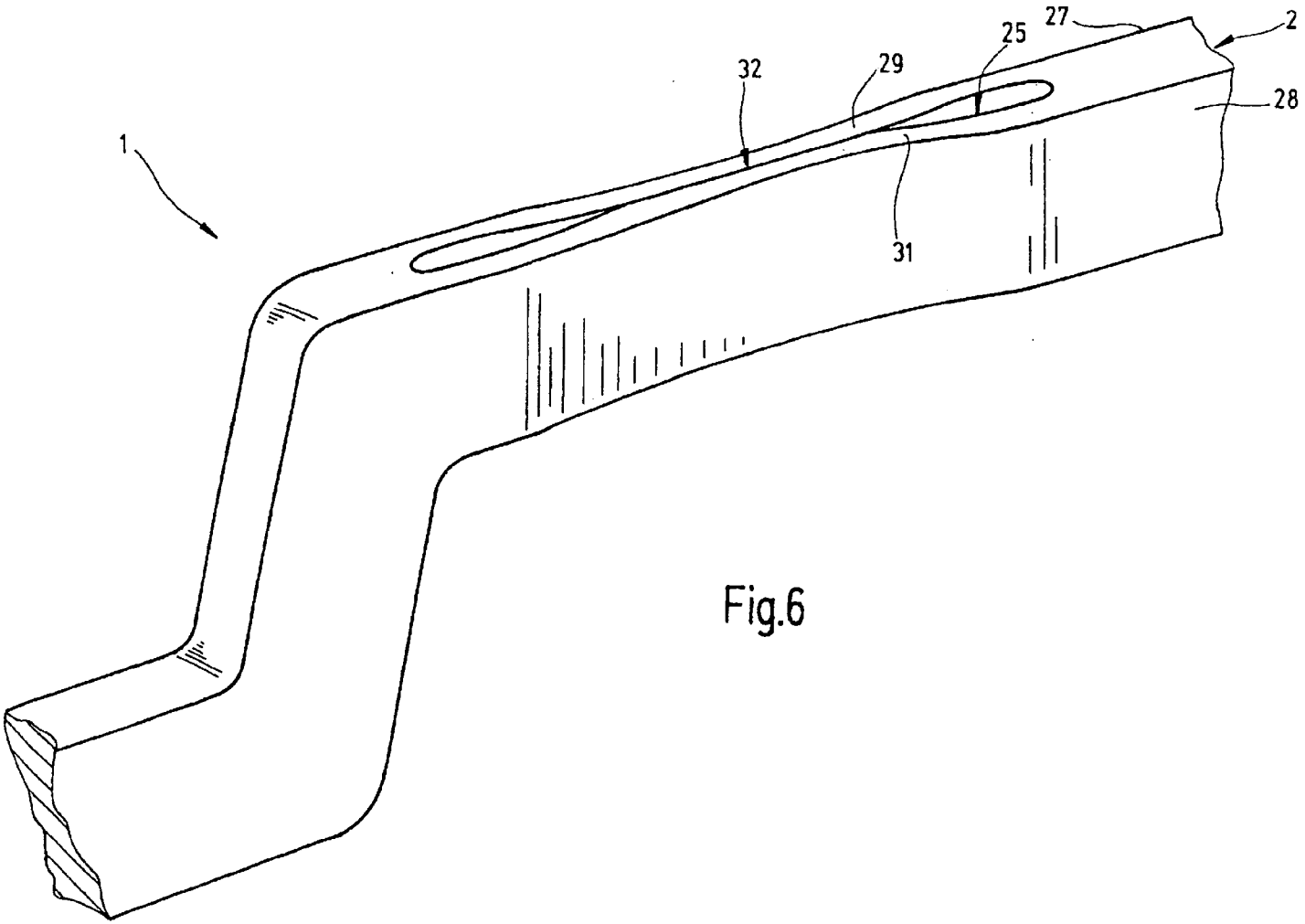
FIG. 6 illustrates another embodiment of a knitting tool with shank indentations on the flanks, in a fragmentary perspective view.
Figure 7:
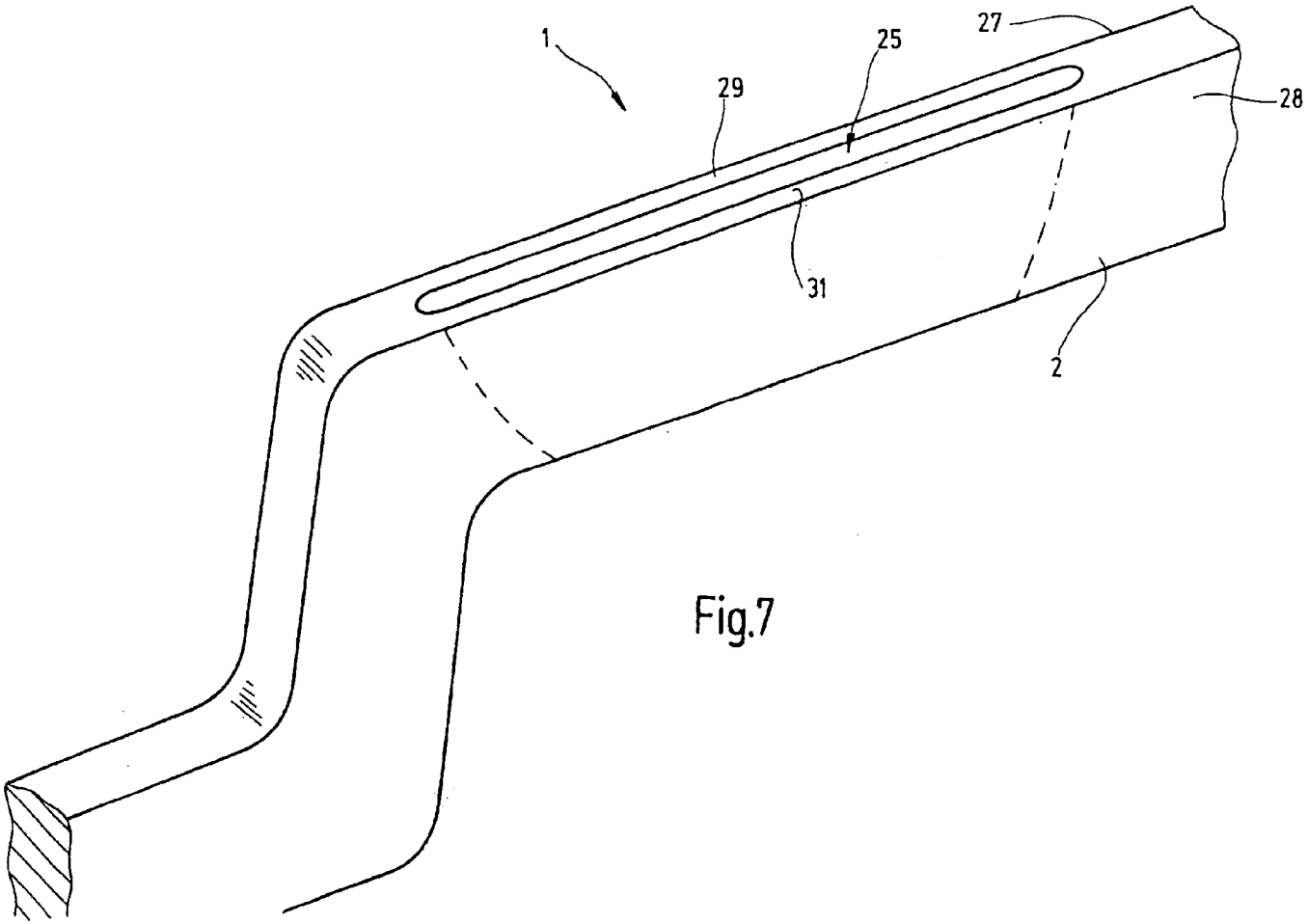
FIG. 7 shows the knitting tool of FIG. 6, in an intermediate step in the production of the indentation on the shank.

The embodiment of the indentations 33, 34 will now be described, taking as an example a portion of a shank of one embodiment of a knitting tool shown in FIGS. 6 and 7:

As FIG. 7 shows, the shank 2 is first provided with the slit 25. The slit 25 is made in a region of the shank 2 where the flanks 27, 28 are to be provided later with the desired indentations. The slit 25 extends through the shank 2 approximately parallel to and between the flanks 27, 28. In a view perpendicular to the flank 28, the slit 25 is thus underneath the region of the flank 28 that is later to be indented. The same is true for a view perpendicular to the flank 27.

Next, approximately at right angles to the flanks 27, 28, a force is exerted on the respective flank 27, 28 in the region of the slit 25. The legs 29, 31 are thus deformed toward one another, creating the indentations 33, 34.

Figure 8:
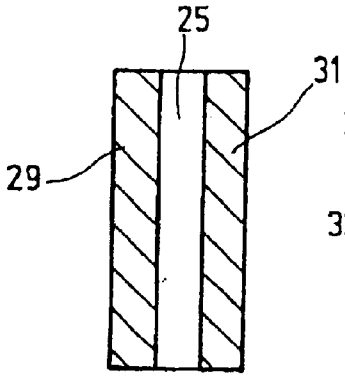
FIG. 8 a cross-sectional view of the shank of the knitting tool of FIG. 7 in the region of the indentation to be formed in the shank.
Figure 9:
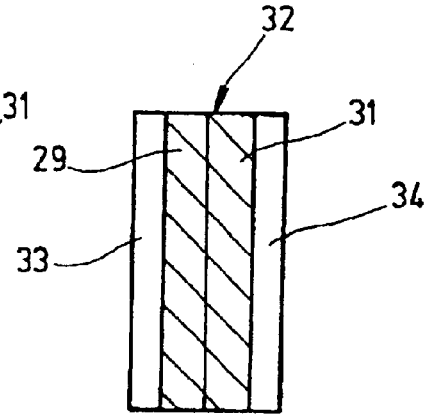
FIG. 9 shows the knitting tool of FIG. 6, in a section transverse to the orientation of the shank.

FIGS. 8 and 9 illustrate the latch needle of FIGS. 6 and 7, in each case in a section taken in the region of the later contacting point 32. The legs 29, 31 are not connected to one another. This lends the latch needle a special flexibility.

Figure 10:
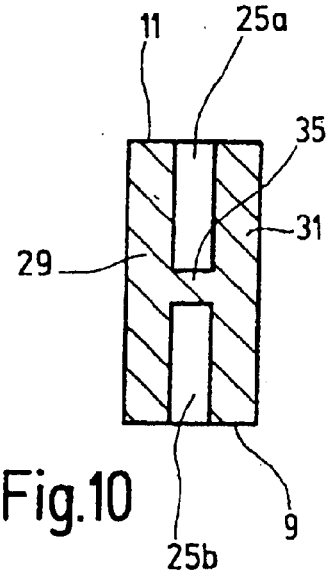
FIGS. 10 and 11 show a modified embodiment of a knitting tool, in a transverse section, before and after the indentation is made.
Figure 11:
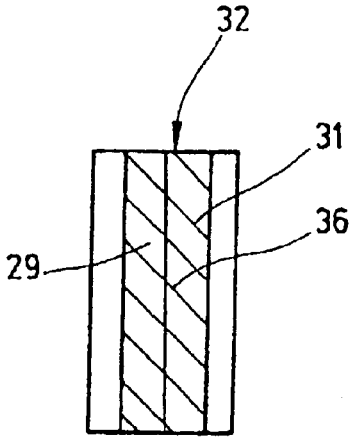

FIGS. 10 and 11 illustrate a modified embodiment in which the slit 25 is subdivided into two partial slits 25*a*, 25*b*. The partial slit 25*a* extends from the top side 11 of the needle into the shank 2. The partial slit 25*b*, conversely, begins at the needle back 9. Between the partial slits 25*a*, 25*b*, a narrow bridge 35 is formed that separates the partial slits 25*a*, 25*b* from one another (FIG. 10). Thus the legs 29, 31 are connected to one another. Upon compression, the narrow bridge 35 is deformed plastically. As FIG. 11 shows, as a result in the region of the contacting point 32 a genuine connection point 36 is formed, which holds the two legs 29, 31 together by material engagement.

Figure 12:
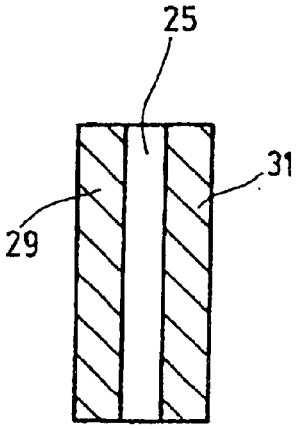
FIGS. 12 and 13 illustrate a further embodiment of a knitting tool with an indentation of its shank, before and after the indentation is made.
Figure 13:
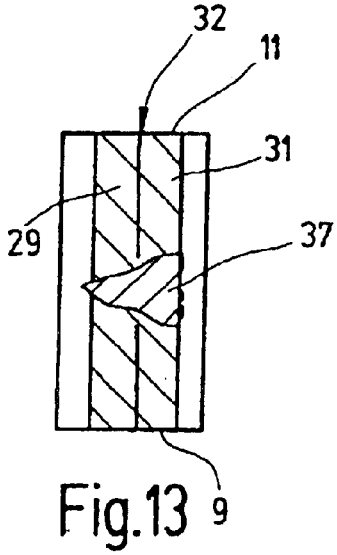

FIGS. 12 and 13 illustrate a further exemplary embodiment with a material bond of the legs 29, 31 after the legs have been deformed. The legs 29, 31, initially completely separated from one another by the slit 25 (FIG. 12), are connected to one another, after being deformed, by a laser spot weld 37 and are thus held against one another. Alternatively, the laser spot weld can be placed on the top side 11 of the needle and/or on the needle back 9.

A knitting tool 1, particular for high-speed knitting machines, has a shank 2 that is provided with indentations 33, 34. For embodying these indentations, the shank 2 is provided with a slit 25, which creates two legs 29, 31 spaced apart from one another. These legs are bent toward one another so that the desired indentations are created at the flanks 27, 28. The indentations serve to reduce friction and to hold oil.

LIST OF REFERENCE NUMERALS

1 Latch needle
2 Shank
3 Portion
4 Guide channel
5, 6 Guide faces
7 Butt
8 Hook
9 Needle back
11 Top side of needle
12, 13, 14, 15 Recesses
16, 17, 18, 19 narrow bridge
21, 22, 23, 24 Intermediate portion
25 Slit
25*a*, 25*b* Partial slits
26 Center plane
27, 28 Flanks
29, 31 Legs
32 Contacting point
33, 34 Indentations
35 narrow bridge
36 Connection point
37 Laser spot weld

What is claimed is:

1. A knitting tool for high-speed machines, having a shank, which can be inserted into a guide channel of a knitting machine and is guided in the guide channel and has a varying thickness, and in regions of reduced thickness, the shank has at least one slit per region, surrounded by two legs, the legs being bent toward one another.

2. The knitting tool of claim 1, wherein the shank has flanks, on which concavely curved indentations are defined that form the regions of reduced thickness.

3. The knitting tool of claim 1, wherein the slit is disposed in a center plane of the shank.

4. The knitting tool of claim 3, wherein the legs are bent toward the center plane.

5. The knitting tool of claim 1, wherein a spacing exists between the legs.

6. The knitting tool of claim 1, wherein the legs touch one another.

7. The knitting tool of claim 1, wherein the legs are connected to one another.

8. The knitting tool of claim 1, wherein the legs are connected to one another by a spot weld.

9. The knitting tool of claim 1, wherein the slit penetrates the shank through its full height.

10. The knitting tool of claim 1, wherein the slit is subdivided into partial slits, and a narrow bridge is embodied between the partial slits.

11. A method for producing a knitting tool, which method comprises providing an initially straight-flanked region with at least one indentation by making a recess, essentially parallel to the flank to be indented, in the knitting tool, with the recess extending essentially parallel to the flank, and then pressing the flank inward into the recess.

* * * * *